US007878352B2

(12) United States Patent
von Spreckelsen et al.

(10) Patent No.: US 7,878,352 B2
(45) Date of Patent: Feb. 1, 2011

(54) OPENING DEVICES FOR FOIL CLOSURES

(75) Inventors: Henning von Spreckelsen, Woking (GB); Peter Michael McGeough, Woking (GB)

(73) Assignee: Bapco Closures Research Ltd., Woking, Surrey (GB)

( * ) Notice: Subject to any disclaimer, the term of this patent is extended or adjusted under 35 U.S.C. 154(b) by 763 days.

(21) Appl. No.: 10/567,891

(22) PCT Filed: Aug. 5, 2004

(86) PCT No.: PCT/GB2004/003403

§ 371 (c)(1),
(2), (4) Date: Feb. 8, 2006

(87) PCT Pub. No.: WO2005/016779

PCT Pub. Date: Feb. 24, 2005

(65) Prior Publication Data

US 2006/0289376 A1 Dec. 28, 2006

(30) Foreign Application Priority Data

Aug. 11, 2003 (GB) ..... 0318837.2
Jun. 2, 2004 (GB) ..... 0412280.0

(51) Int. Cl.
*B65D 39/00* (2006.01)
*B65D 17/34* (2006.01)
*B65D 17/40* (2006.01)
*B65D 47/10* (2006.01)

(52) U.S. Cl. ..... 215/257; 215/232; 215/256; 220/359.2; 220/359.4; 220/270; 220/276; 222/541.9

(58) Field of Classification Search ..... 215/232, 215/257, 305, 256; 220/359.2, 258.2, 270, 220/257.2, 256.1, 276, 359.4; 222/541.9, 222/153.05–153.07, 541.6
See application file for complete search history.

(56) References Cited

U.S. PATENT DOCUMENTS 4,548,333 A * 10/1985 Kobayashi et al. ..... 220/276
4,682,702 A 7/1987 Gach
4,815,618 A * 3/1989 Gach ..... 215/232
4,892,227 A * 1/1990 MacLaughlin ..... 220/270
4,948,015 A * 8/1990 Kawajiri et al. ..... 222/107
5,054,641 A * 10/1991 Sato ..... 220/270

(Continued)

FOREIGN PATENT DOCUMENTS

EP 1266839 A2 12/2002

(Continued)

*Primary Examiner*—Robin Hylton
(74) *Attorney, Agent, or Firm*—K&L Gates LLP

(57) ABSTRACT

Disclosed is an opening device for a foil closure can be fitted to a container body. The device comprises a spout (4) with a removable disc (10) attached to a pull-ring (12). The disc (10) is secured to the spout (4) by means of a frangible region (30). A foil (8) is sealed to a raised land (34) on a base of the disc (10). The pull ring is mounted to the disc (10) by means of legs so that it applies a force on a peninsula (50) of the disc, thereby reducing the length of the arc over which an initial pulling force is dissipated when the initial tear is being initiated reducing the force required to tear the foil (8) by up to 40%.

15 Claims, 6 Drawing Sheets

U.S. PATENT DOCUMENTS 5,125,528 A * 6/1992 Heyn et al. ..... 220/269
5,692,635 A * 12/1997 Farrell et al. ..... 220/270
6,142,334 A * 11/2000 Kristensson ..... 220/270

FOREIGN PATENT DOCUMENTS

GB 1262272 2/1972
GB 2151579 A 7/1985
GB 2192179 A 1/1988
GB 2353789 1/2003
GB 2377701 A 1/2003

* cited by examiner

OPENING DEVICES FOR FOIL CLOSURES

CROSS-REFERENCE TO RELATED APPLICATIONS

This application is the national phase of International (PCT) Patent Application Serial No. PCT/GB2004/003403, filed Aug. 5, 2004, published under PCT Article 21(2) in English, which claims priority to and the benefit of Great Britain Pat. application Ser. No. 0318837.2, filed Aug. 11, 2003, and Great Britain Pat. application Ser. No. 0412280.0, filed Jun. 2, 2004, the disclosures of which are incorporated herein by reference.

BACKGROUND OF THE INVENTION

The present invention relates to opening devices for closures that use a ring pull or tab to tear a foil seal.

The present invention addresses the technical problem of minimising the effort needed to open a container closure. It is important to keep the force required to open containers to a minimum in order to reduce the risk of spillage during opening and to enable frail users to open the closure.

When a ring pull device is used to open a container, the force is transmitted from the finger in the pull ring to a connected part that initiates the opening. In the case of a ring pull for opening a metal can, the tab or pull ring is connected to a pointed nib, which acts on a frangible portion of a seal. The nib concentrates the force applied by the user at a specific point in order to reduce the force that the user needs to apply. Such a construction is described in GB-A-1 262 272 (Cookson).

However when a ring pull is used to tear a plastics seal, it is typically connected to a removable part within a spout by means of one or more legs. See for example GB-A-2 377 701 (Spreckelsen McGeough Ltd) U.S. Pat. No. 4,682,702 (Gach 1) or U.S. Pat. No. 4,815,618 (Gach 2). In Gach 1 a spiral weakening groove is provided in the removable part, which takes the form of a sealing disc that provides the sole seal across an opening in the spout. The spiral groove divides the disc into a tear strip. The legs of the pull ring are attached to the tear strip at the periphery of the disc. Pulling up on the ring starts the separation of the tear strip along both sides of the strip opening the closure. Gach 1 is primarily designed for tamper evidence and ease and obviousness of separation is important for this reason. The pressure required to initiate the tear is determined solely by the depth of the groove. The need to tear a foil creates a further technical problem.

Spreckelsen McGeough Ltd and Gach 2 disclose a closure comprising:

- a spout defining an opening,
- a removable plastics part connected to the spout by means of a frangible region,
- a pulling device connected to the removable part by means of a leg, and
- a foil secured to the removable part and the spout to form a seal across the opening.

With this type of closure the removable part is typically a circular disc. An upward pulling force applied by the user during opening is transmitted to the foil. The force applied by the pulling device is typically distributed over a large arc of the frangible region extending in both directions away from the mounting of the device and also inwardly towards a centre of the removable part. A tear is initiated when the pressure on the foil reaches a tearing threshold or failure modulus, which depends on the nature of the foil. When this type of closure is used with foils having a polypropylene (as taught by Gach 2) or PET compatible layer—as opposed to a polyethylene compatible layer as taught in Spreckelsen McGeough Ltd—the threshold opening pressure is relatively high. This makes this type of closure difficult to open when used with polypropylene and PET containers or plastics laminated with metals or plastics laminated with paperboard containers. This can be understood more clearly by reference to FIG. 1 in which FIG. 1*a* shows a top view of a circular foil to be torn by pulling at the point marked x;

FIG. 1*b* shows a side view illustrating the application of an opening Force F to the foil;

FIG. 1*c* shows an element of the foil;

FIG. 1*d* shows the cross-sectional area A of the foil;

FIG. 1*e* shows the location of al relative to the circular foil;

FIG. 1*f* shows a diagrammatic section through a ring pull attached to a foil at the point of tear;

FIG. 1*g* shows a schematic diagram of FIG. 1*f*; and

FIG. 1*h* show how al increases with increasing diameter of a circular foil.

$$\text{Stress} = \frac{\text{Force}}{\text{Cross-sectional area of foil}} = \frac{F}{A}$$

$$\text{Strain} = \frac{\text{Elongation of foil}}{\text{Original length}} = \frac{e}{l}$$

$$\text{Modulus} = \frac{\text{Stress}}{\text{Strain}} = \frac{F \cdot l}{A \cdot e}$$

The failure stress is when the sample fails as the force (F) is applied across area (A).

For a round foil membrane the area A is calculated by the thickness (t) of the foil times the arc length (al) over which the force is acting. For a given thickness therefore $F \propto al$. The larger the diameter—the larger the arc length over which the force has to act to tear the foil—the larger the force required to reach the same failure stress.

This technical problem of achieving an opening pressure when the pulling force is distributed over a large area increases with the size of the removable part, making it extremely difficult to open wide mouthed PET or polypropylene or plastics laminated metal or paperboard containers and even wide mouth polyethylene containers with this type of closure. This problem can lead to delaminating of the foil and/or snapping of the ring pull.

Once the tear has been initiated, the foil is then torn in both directions away from a base of the leg around the circumference of the disc. The greater the circumference the more upward force is required in order to resolve sufficient force in both directions in the foil bridging the frangible region in order to create and propagate tears running both ways round the disc.

OTHER BACKGROUND ART

GB-A-2 151 579 (Hokkai) shows another foil closure that addresses the technical problem of the high pulling force required to rupture a foil. In this design a pull-open member is adhered to the top of a foil closure member. A pull-tab is connected to the pull-open member by means of a weakened portion to facilitate the initial tear. Unlike the use of a leg, as in Gach 2 or Spreckelsen McGeough Ltd, the position of this pull tab initially in the same plane as the pull-open member means that, even when it is lifted, only a proportion of the applied pulling force resolves in the direction normal to the plane of the foil creating pressure to rupture the foil. The design of the pull-open member is intended to direct the tear in one direction only to peal open the whole foil.

SOLUTION OF THE INVENTION

It has now been appreciated that, since the foil must be subject to sufficient pressure to rupture it during an opening operation, the required pulling force can be reduced by decreasing the area of the removable part subjected to the pulling force, and, more specifically, by limiting the length of an arc of the frangible region over which an initial pulling force is dissipated when the tear is being initiated. The present invention solves the technical problem by providing structures that achieve this requirement.

In one aspect, the closure of the present invention is characterised in that the leg is mounted such that it applies a force on a peninsula of the removable part. Preferably the leg is mounted on the peninsula at a periphery of the removable part.

By applying the pulling force to a peninsula of smaller area than the whole of the removable part, the pressure applied to the foil is increased for a given pulling force, as it is effectively only applied to the area of the peninsula.

In one preferred embodiment the peninsula is defined in the removable part between a pair of projections projecting from the spout. Alternatively the peninsula may be defined as a portion of the removable part that projects into an indentation in the spout.

Preferably a cutting tooth is provided on an underside of the spout adjacent each side of the peninsula so that the pulling force stretches the foil against the cutting teeth. Where the pulling device is a ring having two spaced parallel legs rooted side by side on the peninsula on a line that is the same as or close to a centre line of the teeth.

In an embodiment in which the peninsula projects from the removable part and is too small to accommodate a base of both legs, a buttress extends from the legs onto the peninsula between a centre line of the teeth.

In an alternative embodiment the peninsula is defined in the removable part by means of a slit extending across the removable part from the periphery.

In all cases the peninsula structure results in a limited arc of the frangible region to which a pulling force created by the pulling device is applied and thereby increases a tearing pressure on the foil.

The ease of opening can also be facilitated by propagating the tear along a one-way route as taught by Hokkai. However this creates a subsidiary technical problem of ensuring that the tear can propagate all the way round the removable part. In the case of embodiments with symmetrical peninsulas the tears initiated by the teeth at each side will propagate in both directions simultaneously in the frangible region.

Placing the mounting of the pull ring on a peninsula defined by the slit reduces the length of the arc over which an initial pulling force is dissipated when the tear is being initiated reducing the force required to tear the foil by up to 40%. The presence of the slit ensures that the pulling force applied during opening lifts the peninsula, which may be a corner of the part to one side of the slit to which the leg is attached. It is therefore preferable to mount the leg as close as possible to the corner. In a preferred embodiment two spaced legs are used to connect the removable part to the pulling device and this allows the leg closer to the slit to act independently. Once initiated, the tear will propagate in one direction only around the removable part thus reducing the opening force. By using a slit instead of a weakened groove as in Gach 1, only one side instead of two needs to tear to open the closure.

The mounting position of the legs of the pull ring in Gach 1 is significantly separated from a tip of the spiral tear strip so that, even if this closure were adapted for use with a foil, the arc over which the pulling force is applied is similar to that for a plane disc.

Preferably the slit extends from an edge of the plate passing close to and beyond the centre. The slit could curve or even define a spiral but a straight slit is simpler to mould and effective.

The closure is particularly advantageous when used with any double-sided foil, but in particular those with a polypropylene or PET membrane, to weld to a container of that material, as such foil is more difficult to tear.

Preferably the removable part is a plate having a raised land to which the foil is attached rather than being welded to the entire surface as taught in Gach 2. Reducing the surface area of the land reduces the energy needed for induction heat-sealing of the foil to the spout and thereby increases the speed at which the closures can be produced and used.

In another aspect and more generally, the present invention also provides a closure comprising a spout defining an opening, a plastics part connected to the spout by means of a frangible region, a foil attached to the plastics part and the spout to form a seal across the opening, and a device for applying a force to a peninsula at the periphery of the removable part.

The closure is particularly advantageous when used with wide mouthed containers with diameters in excess of 38 mm. With such containers the gentler curvature results in longer lengths of arc over which the force is distributed in conventional designs. Therefore the problem of generating an opening pressure sufficient to tear the foil is particularly significant in closures of this size.

The same solution can be applied to foil sealed plastics closures where the tear is initiated by a pushing action rather than the prior art pulling device. As discussed above, modern metal ring pull openings effectively push on a frangible region by means of a nib. This reduces the littering problem as the ring pull and the part of the closure that closes the opening (referred to above as a removable part) are not removed but remain connected to the container with the closure part being pushed into the body of the container. In this variation the force-applying device is preferably a pushing device having a nib acting initially on the peninsula, instead of a pulling device.

As with the pulling device embodiments, the nib enables the threshold pressure to initiate the tear in the foil to be created with reduced force.

The closures of the invention can be used with overcaps that engage with the spout by threads, snap fit onto the spout or are adapted to screw to a neck of a bottle to which the closure is fitted.

BRIEF DESCRIPTION OF THE DRAWINGS

In order that the invention maybe well understood, three embodiments thereof will now be described, by way of example only, with reference to the accompanying diagrammatic drawings, in which.

DETAILED DESCRIPTION OF THE EMBODIMENTS

Figure 1A:
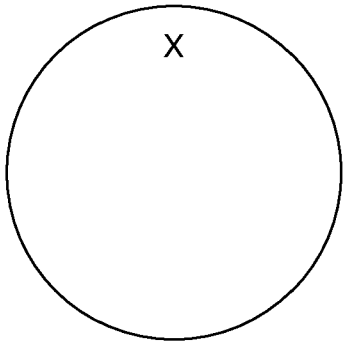
FIGS. 1*a*-1*h* show diagrams to illustrate the geometry of foil tearing as described above.
Figure 1B:
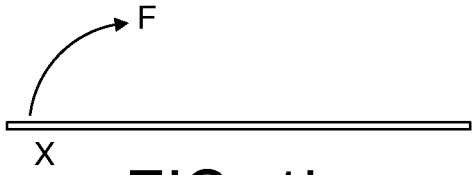
Figure 1C:
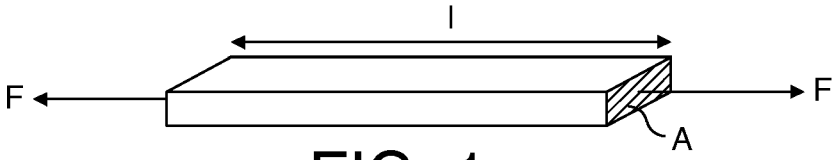
Figure 1D:
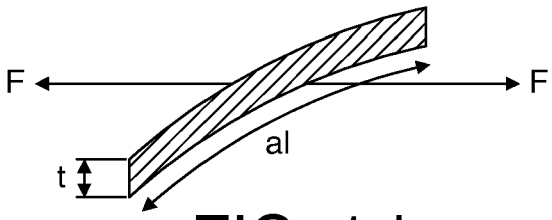
Figure 1E:
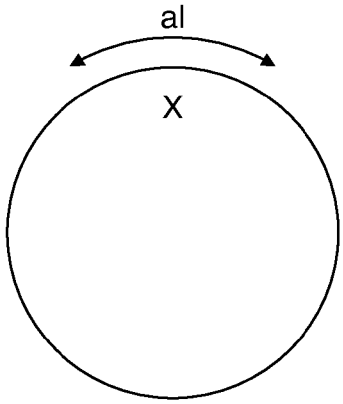
Figure 1F:
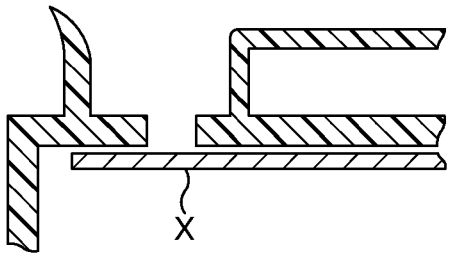
Figure 1G:
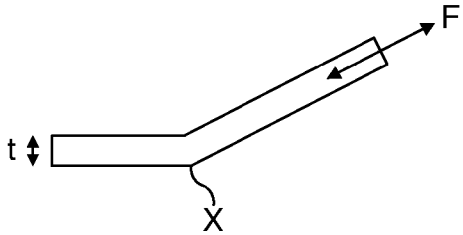
Figure 1H:
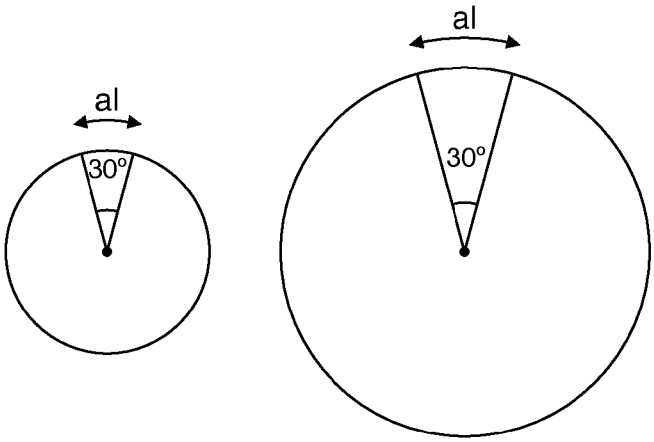

A closure 2 takes the form of a spout 4 and an overcap (not shown). The spout 4 is intended to be fitted to a container body. The spout defines an opening 6 that is sealed by a foil 8 and a removable plate 10 in the form of a disc. A pulling device 12 in the form of a pull ring is mounted to the disc 10 by means of a pair of spaced legs 14.

Although the closure of each embodiment is shown as having a circular configuration, which is preferable for pouring, it will be appreciated that the closure may, without deviating from the principles described, be square or oval or have other geometries.

Figure 4:
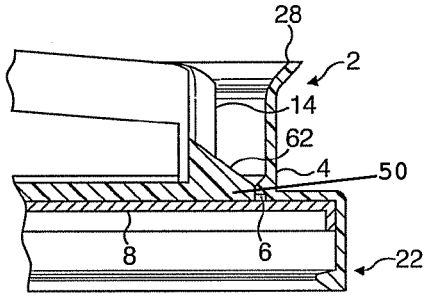
FIG. 4 shows a vertical section through the leg mounting of the closure of FIG. 3 along the line II in FIG. 3.

The spout 4 has a tapered annular wall 20 that provides a pourer for the closure 2. The wall 20 is supported on a base 22 that fits to a container body. As shown in FIG. 4, the base 22 comprises a flat annular flange 24 surrounding the opening 6 and a skirt 26 designed to be fitted to the container body. It will be appreciated that the design of the base 22 can be modified for use with different types of container including all types of plastics bottles and bottle neck designs as well as containers made of composite materials incorporating a plastics layer such as steel/plastics laminate, aluminium/plastics laminate, paper/plastics laminate and paper/EVOH/plastics laminate.

The wall 20 terminates in a projecting pour lip 28, which is slightly tapered towards a pouring edge.

The spout 4 is intended to be closed by means of an overcap (not shown). The overcap may snap fit over the wall 20 as described in Spreckelsen McGeough Ltd. Alternatively screw threads maybe formed on an external surface of the wall 20 or the skirt 26 or the bottle neck in order to engage with a threaded overcap.

Opposite the pour lip 28, the wall 20 merges with the annular flange 24 of the base 22. Inside the wall 20 the removable disc 10 is connected to the spout 4 at a frangible region 30 that takes the form of an annular gap, which is bridged by a plurality of spaced bridges 32. The bridges 32 are not evenly spaced relative to one another around the frangible region 30. Approximately twice as many bridges 32 are provided in a quarter of the frangible region adjacent the legs 14 where the tear is initiated. Different configurations are also possible.

The pulling device is a pull ring 12 supported on the disc 10 by means of a pair of spaced legs 14.

The foil 8 is a multi-layer foil that is weldable on both sides as a result of plastics coatings applied to both surfaces. Each coating must be of a plastics material compatible with that of the container body and spout respectively.

The disc 10 is induction heat sealed to the foil 8 at a raised land 34 on a base of the disc 10. The land 34 has a portion 36 extending around an edge of the disc adjacent to the frangible region 30 with an enlarged portion 38 directly beneath the mounting of the legs 14. A second portion 40 of the land projects from the centre of the disc 10 to the enlarged portion 38 and communicates with the base of legs 14. This portion 40 is provided for the purposes of efficient injection moulding of the closure 2. The foil is also heat sealed to an underside of the annular flange 24. It will be appreciated that it is preferable to keep the area of the land 34 as small as possible to minimise the energy needed for creating the heat seal, while retaining the foil 8 in position and enabling it to be torn when the removable part 10 is lifted by the pulling device 12. When the closure is fitted to a container, an exposed lower face of the foil 8 is heat sealed to the container. The invention does not preclude the fitting of the closure to a container body by other means such as adhesive.

The foil 8 must be held securely directly beneath the pulling device in order to ensure that the pulling force initiates the tear in the frangible region 30 and does not separate from the disc as the closure is opened. The enlarged portion 38 of the land also stiffens the disc 10 at the junction between the pulling device and the disc to prevent breakage at this point.

The above description relates to all three embodiments illustrated. Where the embodiments differ is in the structure of a peninsula of the disc 10 on which the spaced legs are mounted.

In all of the drawings, for sake of clarity and differentiation of the ring pull 12 from the edge of the disc 10, the relative distances between the parts has been enlarged. In practice the mounting of the legs 14 has to be as close as practicable to the edge and, in the case of the embodiment of FIG. 5, as close as possible to a slit 70, in order to achieve the benefits of the invention for the reasons that will become apparent to the skilled man on reading this specification.

Figure 2:
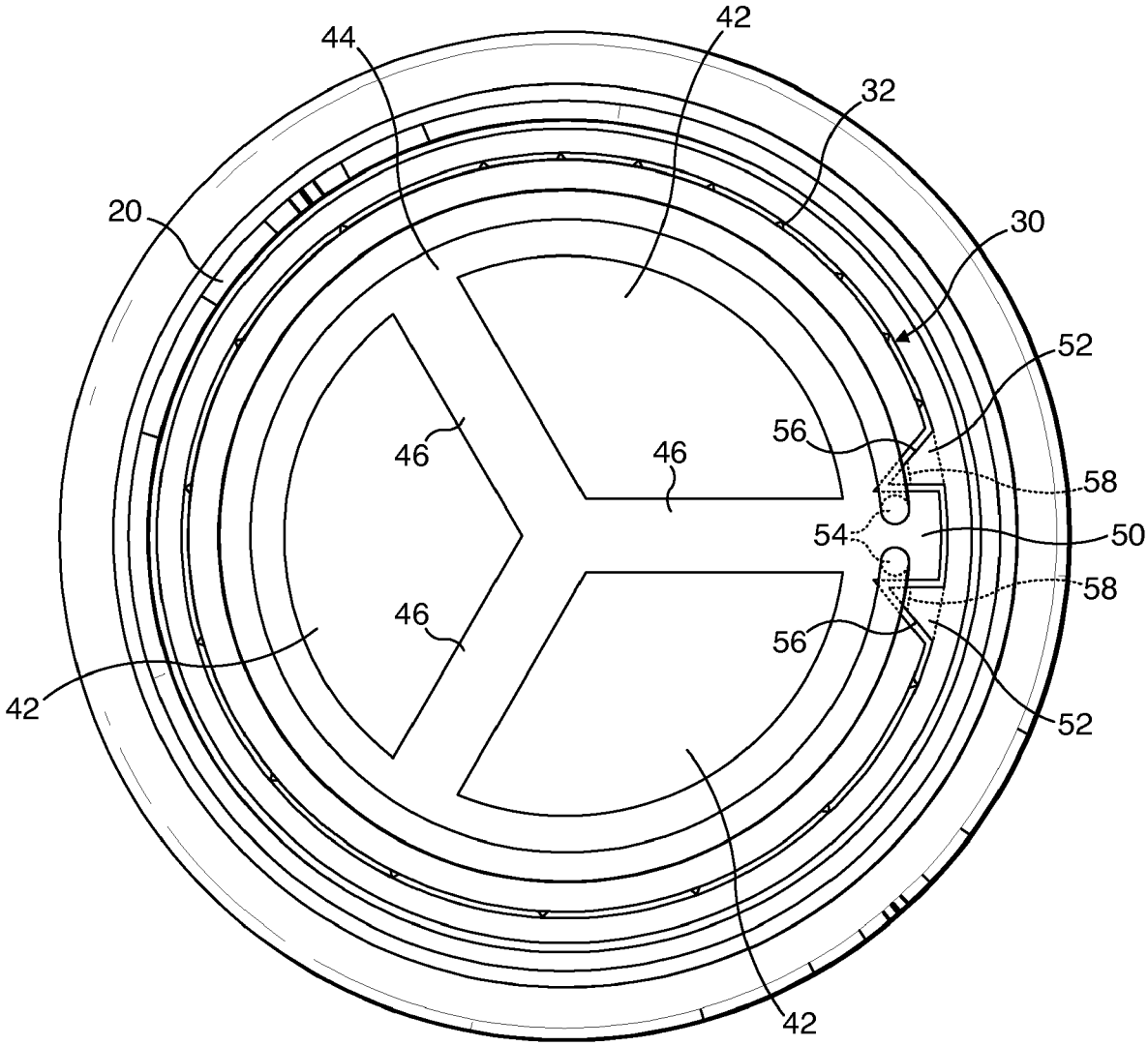
FIG. 2 shows a top plan view of a closure of a first embodiment.

First Embodiment Mounting (FIG. 2)

In the first two embodiments the disc 10 has three triangular openings 42 that define an annular ring 44 around the periphery of the disc and three arms 46 that converge at a centre of the disc. This saves weight.

In this embodiment a peninsula 50 is defined at the periphery of the disc 10 by means of two spaced notches 52 that project in the ring 44 to provide a peninsula 50 sufficiently deep to house the bases 54 of both legs 14.

Projections 56 project from the spout at the position of each notch 52. Each projection 56 supports on its lower surface a large cutting tooth 58 shown in dotted line moulded from the plastics material of the spout. The cutting tooth 58 may have any suitable profile intended to facilitate initiation of a tear when the foil 8 is stretched across it.

A centre line 60 joining the centres of the teeth 58 passes through or close to the bases 54 of both legs 14 so that as a pulling force is applied to the legs, the foil 8 is stretched immediately over the teeth 58 initiating a tear.

In this embodiment the projections 56 projecting from the otherwise smooth curved surface of the spout may impede the outflow of the contents of the container. The junction of the projections 56 with the spout may be weakened so that they can be snapped off after the closure has been opened to leave a smooth edge once again. However the design of the weakening must not be such as to allow the projections to lift during the opening of the closure to reduce the cutting effect of the teeth 58 on the foil. This can be achieved by providing a recess in a lower surface of the projections so that a downward force can snap them off.

Figure 3:
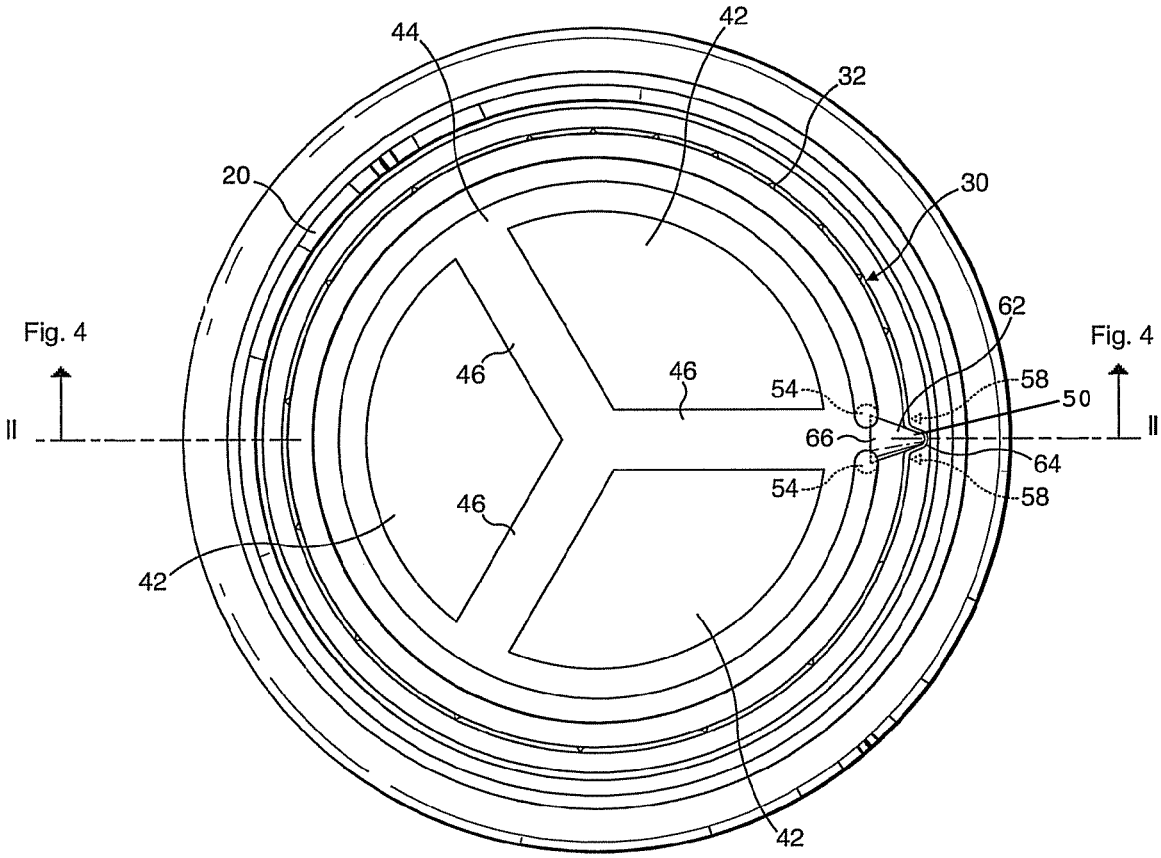
FIG. 3 shows a top plan view of a closure of a second embodiment.

Second Embodiment Mounting (FIGS. 3 and 4)

In the embodiment of FIG. 3 the mounting the legs 14 are mounted by means of a buttress structure 62 supported on a peninsula 50 that projects from the periphery of the ring 44 into a corresponding indentation 64 in the spout 6. Cutting teeth 58 are formed underneath the spout at either side of the indentation 64.

The buttress 62 is a triangular plastics nose that extends from a web 66 joining the lower part of the parallel legs 14 in the portion nearest their base. A base of the buttress 62 merges with the peninsula 50. The presence of the buttress 64 allows the application of pulling force with the pulling ring 12 to apply a force to the peninsula 50, even though the bases of the legs 14 cannot be rooted on the peninsula 50 itself.

In this embodiment the peninsula 50 has the effect of reducing the diameter of the arc over which the pulling force is spread.

Figure 5:
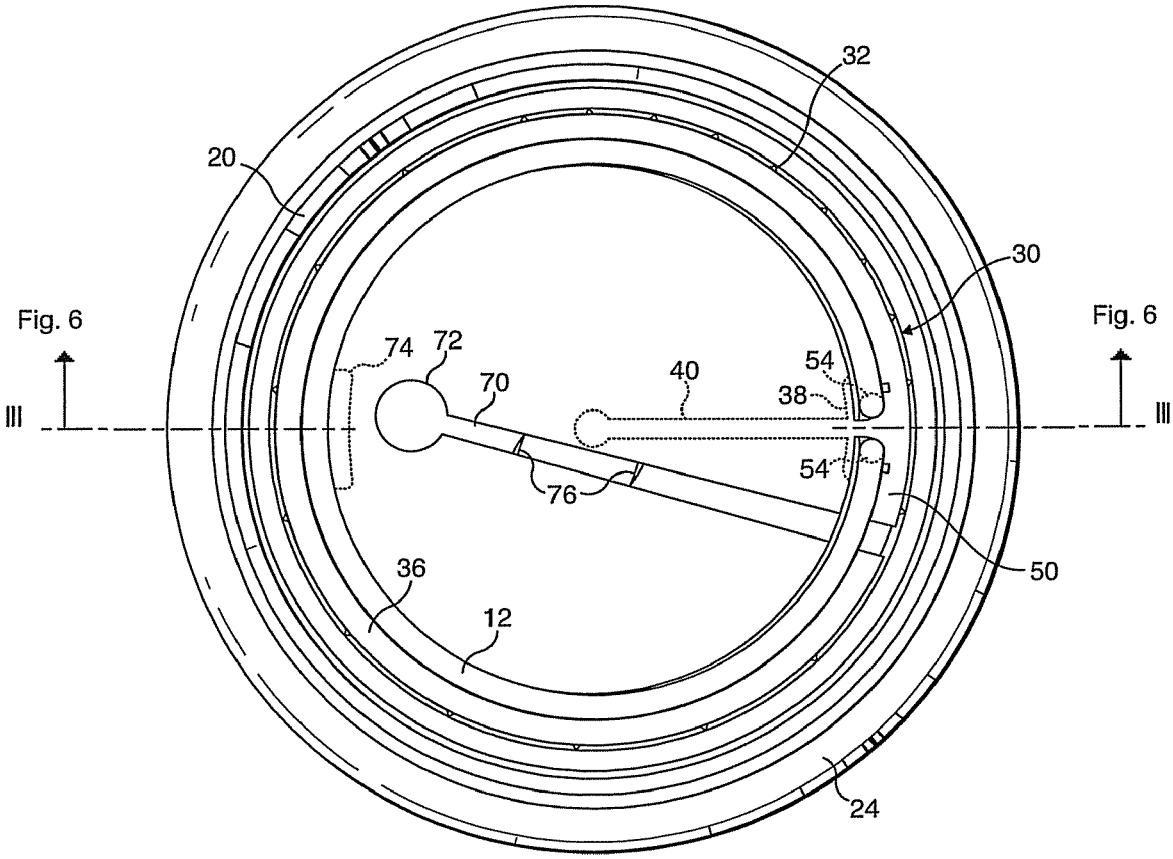
FIG. 5 shows a top plan view of a closure of a third embodiment.
Figure 6:
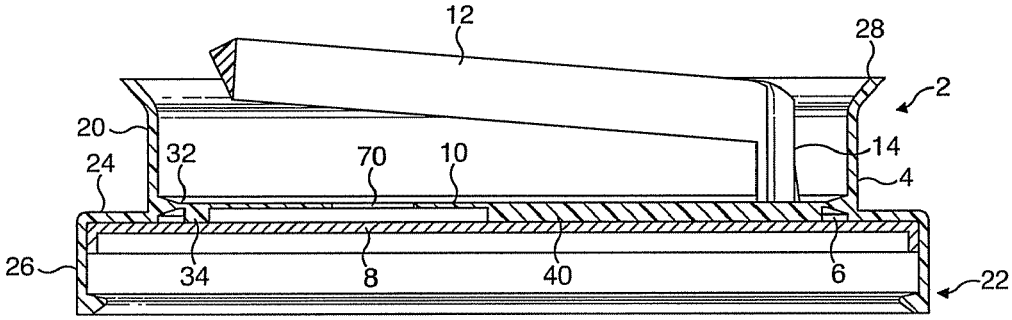
FIG. 6 shows a section on the line III-III in FIG. 5.
Figure 7:
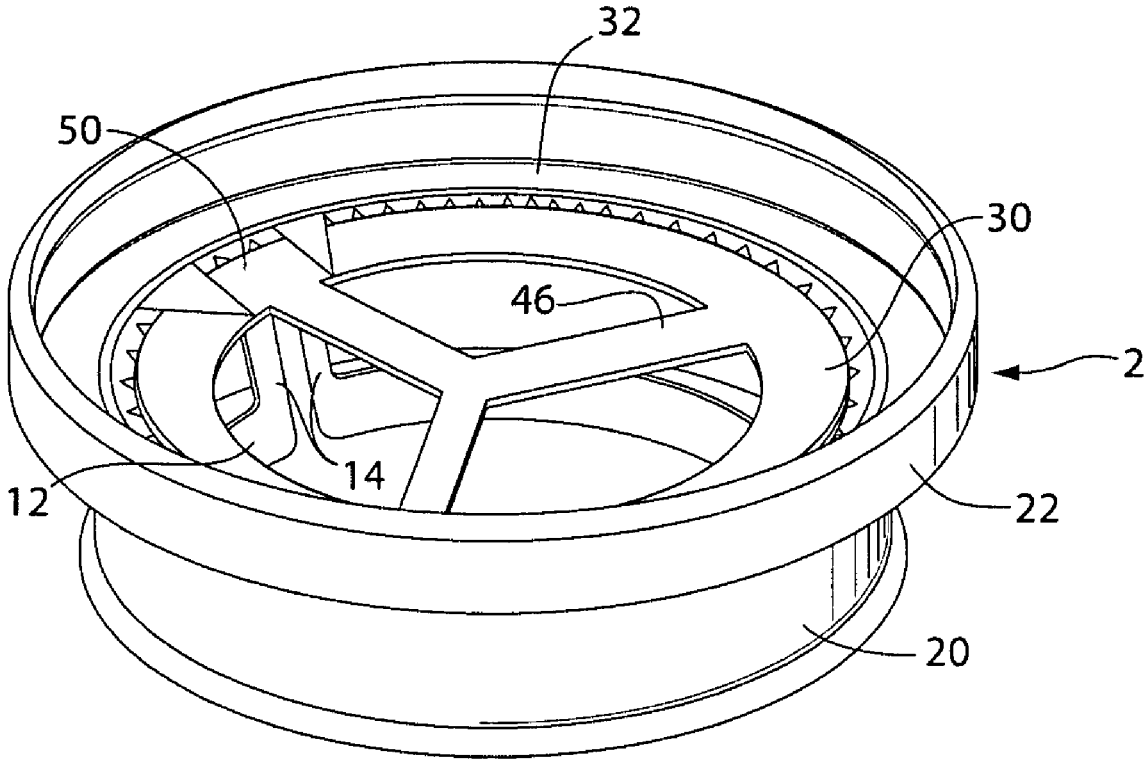
FIG. 7 shows a perspective view of the closure of FIG. 2.

Third Embodiment Mounting (FIGS. 5 and 6)

A slit 70 extends from an edge of the disc just beyond the enlarged portion 38 of the land 34. The slit passes off centre, skirting the end of the land portion 40 and terminates short of an opposite edge of the disc 10. The slit 70 is provided with an enlarged circular end 72 in order to reduce the risk of the removable part 10 being severed in two during removal. Such breakage could occur if the disc 10 is broken at a neck between an end 72 of the slit across to the frangible region 30. The land 34 has a further enlarged portion 74 in this neck area opposite the end 72 of the slit 70 to prevent the removable part 10 breaking at this point. Weak bridges 76 cross the slit 70 at its open end adjacent the corner-shaped peninsula 50 on which the legs 14 are mounted and at an intermediate point. These bridges 76 are to enable the disc to be moulded and are sufficiently fine to sever when subjected to minimal pulling force. The slit 70 effectively divides the plate 10 into a U shape with a pull ring attached solely and securely to one limb that is the peninsula 50. Due to the open slit 70, the pulling force applied by pulling on the pull ring 12 is concentrated solely on the limb to which it is attached. The foil 8 will initially stretch in the region attached to the enlarged land portion 38. The presence of the slit 70 reduces the arc of the frangible region over which the force is applied. The pulling device needs to be mounted as close as practicable to the peninsula corner at the end of the slit to ensure that the pulling force is applied over as small an area as possible so that a tearing threshold pressure is achieved with minimal exertion in order to initiate the tear. As the legs 14 are mounted on a readily free-able corner of the plate 10 next to the slit 70, the effect is to cause the user to pull, not directly upwards, but at an angle skewed towards the intended direction of propagation of the tear. This further reduces the area of the foil that is subjected to the pulling force. Using two legs allows the leg 14 closest to the slit 70 to define the centre of the arc.

Continued pulling propagates a tear around the edge of the disc 10 adjacent the enlarged land portion 38. The user will then pull the disc away directing the tear away from the slit all the way around the circular edge of the disc 10. A secondary tear directed towards the puller will generally be created beneath the slit as the released part of the disc is lifted by the opening action. The circular end 72 of the slit 70 and the enlarged land portion 74 are intended to prevent the disc breaking so that only a semicircular part is removed. However for some containers, removal only of part of the disc may be sufficient.

The slit 70 may have various configurations that will effectively vary the way the disc is removed in a single strip-like way. A J-shape or spiral slit may be used.

Variation

In a variation of any of the embodiments described, the closure has a pushing device in place of the pulling device. The pushing device has a nib or tooth that acts either directly on the foil within the slit 70 or on the peninsula 50. The plastics part 10 is not completely removed when this embodiment of the closure is opened, as it will be pushed into the container. This is preferred for those types of drinks container that are opened in public places where removable closure parts could create a littering problem.

Various designs of pushing device may be employed dependent on the strength of the foil that has to be torn. A pull ring or tab mounted on a pivoting point to one side of the frangible region as used with metal closures may be employed. The pushing device could also be a tab mounted directly to the plastics part 10.

As with the previous embodiments, the nib enables the threshold pressure to initiate the tear in the foil to be created with reduced force. Continuing to push the plastics part 10 into the container will propagate the tear. Where the nib acts directly on the foil, shoulders of the pushing device will act on plastics part 10 at the sides of the slit after the nib has initiated the tear causing the tear to be propagated in both directions away from the slit.

The invention claimed is:

1. A sealed closure comprising:

a spout defining an opening;

a removable plastic part disposed over the opening and connected to the spout by a frangible region, the removable part including a peninsula formed between the frangible region and a slit that divides the removable part and extends into the removable part from an edge of the removable part;

a tearable seal disposed across the opening and attached to the peninsula;

a pull ring; and a leg connecting the pull ring to the peninsula;

wherein the seal is torn when a force applied to the pull ring is concentrated onto the peninsula, wherein the leg is connected to the peninsula at a periphery of the removable part, and wherein a cutting tooth is provided on an underside of the spout adjacent each side of the peninsula.

2. A sealed closure as claimed in claim 1, wherein the slit extends from the edge of the removable part passing close to and beyond a center of the removable part.

3. A sealed closure comprising:

a spout defining an opening;

a removable plastic part disposed over the opening and connected to the spout by a frangible region, the removable part including a peninsula formed between the frangible region and a slit that divides the removable part and extends into the removable part from an edge of the removable part;

a tearable seal disposed across the opening and attached to the peninsula;

a pull ring; and a leg connecting the pull ring to the peninsula;

wherein the seal is torn when a force applied to the pull ring is concentrated onto the peninsula, wherein the leg is connected to the peninsula at a periphery of the removable part, and wherein the slit is straight.

4. A sealed closure as claimed in claim 1, wherein the seal is a foil.

5. A sealed closure as claimed in claim 4, wherein the foil is welded to a container closed by the closure.

6. A sealed closure as claimed in claim 4, wherein the removable part is a plate having a raised land to which the foil is attached.

7. A sealed closure as claimed in claim 4, wherein the foil is a multi-layer foil that is weldable on both sides.

8. A closure comprising a spout defining an opening, a plastic removable part disposed over the opening and connected to the spout by a frangible region at an edge of the removable part, the removable part having a peninsula defined by a slit extending into the removable part from the edge of the removable part, a foil attached to the plastic removable part at an enlarged portion of a land beneath the peninsula and to the spout to form a seal across the opening, and a device mounted on the peninsula for applying a force to the peninsula at a periphery of the removable part.

9. A closure as claimed in claim 8, wherein the force-applying device is a nib.

10. An apparatus comprising:

a container body; and a closure comprising a spout defining an opening, a plastic removable part disposed over the opening and connected to the spout by a frangible region at an edge of the removable part, the removable part having a peninsula defined by a slit extending into the removable part from the edge of the removable part, a foil attached to the plastic removable part at an enlarged portion of a land beneath the peninsula and to the spout to form a seal across the opening, and a device mounted on the peninsula for applying a force to the peninsula at a periphery of the removable part;

wherein the container body is secured to the closure by means of the foil.

11. The apparatus of claim 10, wherein the container is made of a material selected from plastics laminate, combined with another material, such as steel or paperboard; PET; or polypropylene.

12. A sealed closure as claimed in claim 3, wherein the seal is a foil.

13. A sealed closure as claimed in claim 12, wherein the foil is welded to a container closed by the closure.

14. A sealed closure as claimed in claim 12, wherein the removable part is a plate having a raised land to which the foil is attached.

15. A sealed closure as claimed in claim 12, wherein the foil is a multi-layer foil that is weldable on both sides.

* * * * *